US006371247B1

(12) United States Patent
Nedderman, Jr.

(10) Patent No.: US 6,371,247 B1
(45) Date of Patent: Apr. 16, 2002

(54) LIFT ASSEMBLY

(75) Inventor: William H. Nedderman, Jr., Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/520,816

(22) Filed: Mar. 8, 2000

(51) Int. Cl.[7] ..... B66F 7/02

(52) U.S. Cl. ..... 187/211; 254/124; 254/127; 254/128; 254/387; 187/254; 187/259; 187/261; 187/262; 187/269

(58) Field of Search ..... 187/211, 213, 187/216, 269, 219, 254, 261, 259, 262; 254/387, 122, 124, 127, 128

(56) References Cited

U.S. PATENT DOCUMENTS

| | | | | | |
|---|---|---|---|---|---|
| 182,070 | A | * | 9/1876 | Hennert | 254/122 |
| 382,077 | A | * | 5/1888 | Dick | 187/211 |
| 1,458,032 | A | * | 6/1923 | Cornell | 187/211 |
| 1,630,191 | A | * | 5/1927 | Liberman | 187/211 |
| 3,641,835 | A | * | 2/1972 | Tornheim | 74/501.5 |
| 3,785,462 | A | * | 1/1974 | Coad t al. | 187/18 |
| 4,391,345 | A | * | 7/1983 | Paul | 182/141 |
| 4,585,212 | A | * | 4/1986 | Yanker | 254/122 |

FOREIGN PATENT DOCUMENTS

| | | | | |
|---|---|---|---|---|
| DE | 35 19 82 | A1 | * 12/1986 | 254/122 |

* cited by examiner

*Primary Examiner*—Eileen D. Lillis
*Assistant Examiner*—Michael Lowe
(74) *Attorney, Agent, or Firm*—Michael J. McGowan; Prithvi C. Lall; Michael F. Oglo

(57) ABSTRACT

A lift assembly includes first and second elevator structures, each including a first scissors section, a second scissors section pivotally connected to the first scissors section and supporting a lift shaft which extends between the first and second structures, at least one intermediate scissors section pivotally connected to the second scissors section, and an upper scissors section pivotally connected to an uppermost of the intermediate scissors sections and supporting a top bar. First and second side plates upstand adjacent the first and second structures, each having therein an elongated slot, the lift shaft being disposed in the slots. A lower pulley is mounted proximate each of the base bars on a common drive shaft. An upper pulley is mounted proximate an upper end of each of the side plates. A strand extends from each of the lower pulleys to each of the upper pulleys, and thence to the lift shaft. A motor is operable to rotate the drive shaft and thereby the lower pulleys to draw in the strand to draw the lift shaft upwardly in the side plate slots, to draw the second scissors section, and thereby remaining scissors sections, upwardly, to raise the top bar.

14 Claims, 3 Drawing Sheets

LIFT ASSEMBLY

STATEMENT OF GOVERNMENT INTEREST

The invention described herein may be manufactured and used by and for the Government of the United States of America for Governmental purposes without the payment of any royalties thereon or therefore.

BACKGROUND OF THE INVENTION

1. Field of the Invention

The invention relates to lifting devices and is directed more particularly to a "scissors" lift.

2. Description of the Prior Art

Scissors lifts are known in the art and generally include a number of scissors sections pivotally connected in a vertical array and expandable from a compressed condition and low level disposition to a relatively expanded condition and a higher level disposition. Each scissors section includes side-by-side pairs of crossed arms pivotally connected to each other at their centers and at their outer ends. They may be expanded and contracted in a bellows-like fashion.

Such lifts generally are constructed of rigid, heavy elements, otherwise the upper sections may fail to extend when extension force is applied to the lower sections. In addition, lightly constructed scissors lifts tend to be unstable, in that one side, or one of the elevator structures, rises faster than the other, causing the apparatus to sway.

There is a need for a scissors lift, which is constructed of relatively light and inexpensive material, is of relatively low weight, yet is stable and reliable.

SUMMARY OF THE INVENTION

An object of the invention is, therefore, to provide a scissors lift, which is constructed so as to provide stable and reliable operation.

A further object of the invention is to provide such a lift constructed of relatively light weight materials.

With the above and other objects in view, as will hereinafter appear, a feature of the present invention is the provision of a lift assembly having first and second elevator structures side-by-side. Each of the structures comprises a first scissors section mounted on a base bar, a second scissors section pivotally connected to the first scissors section, arms of the second scissors section being pivotally connected to each other by a lift shaft which extends between the first and second structures, at least one intermediate scissors section pivotally connected to the second scissors section, and an upper scissors section pivotally connected to an uppermost of the intermediate scissors sections and supporting a top bar. First and second side plates upstand adjacent, respectively, the first and second structures, each of the side plates having therein an elongated slot, the lift shaft being disposed in the slots. A lower pulley is mounted proximate each of the base bars on a common drive shaft. A motor for rotating the drive shaft is provided. An upper pulley is mounted proximate an upper end of each of the side plates. A strand extends from each of the lower pulleys to each of the upper pulleys, respectively, and thence to the lift shaft. The motor is operable to rotate the drive shaft, and thereby the lower pulleys, to draw in the strand from the upper pulleys which support the strand to draw the lift shaft upwardly in the side plate slots, to draw the second scissors section, and thereby remaining scissors sections, upwardly, to raise the top bar.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 2:
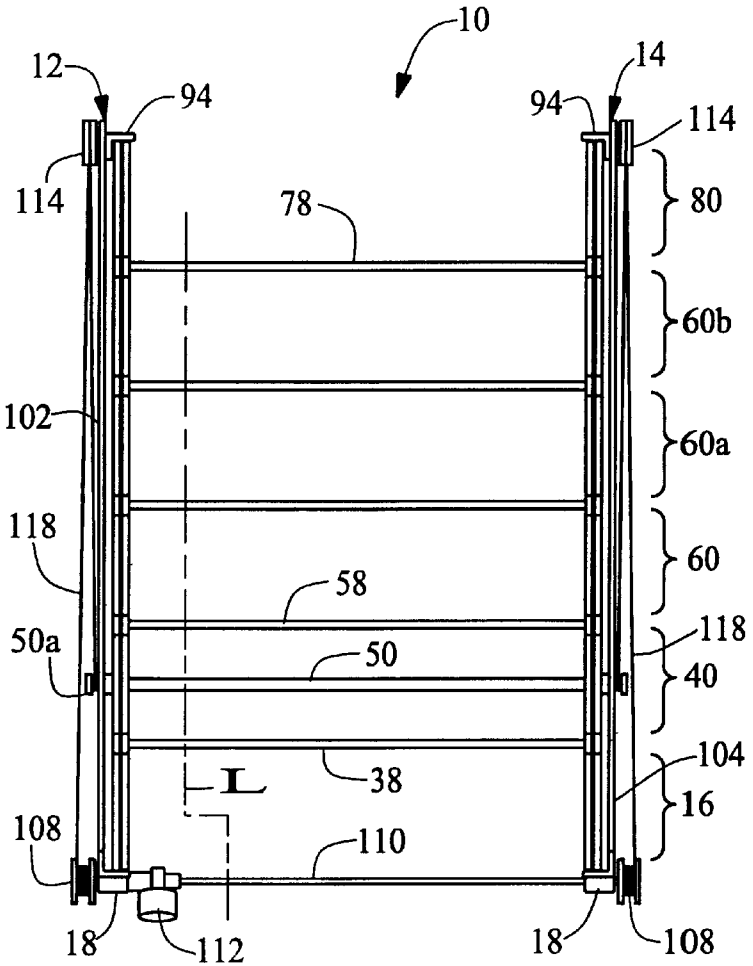
FIG. 2 is a front elevational view thereof.
Figure 1:
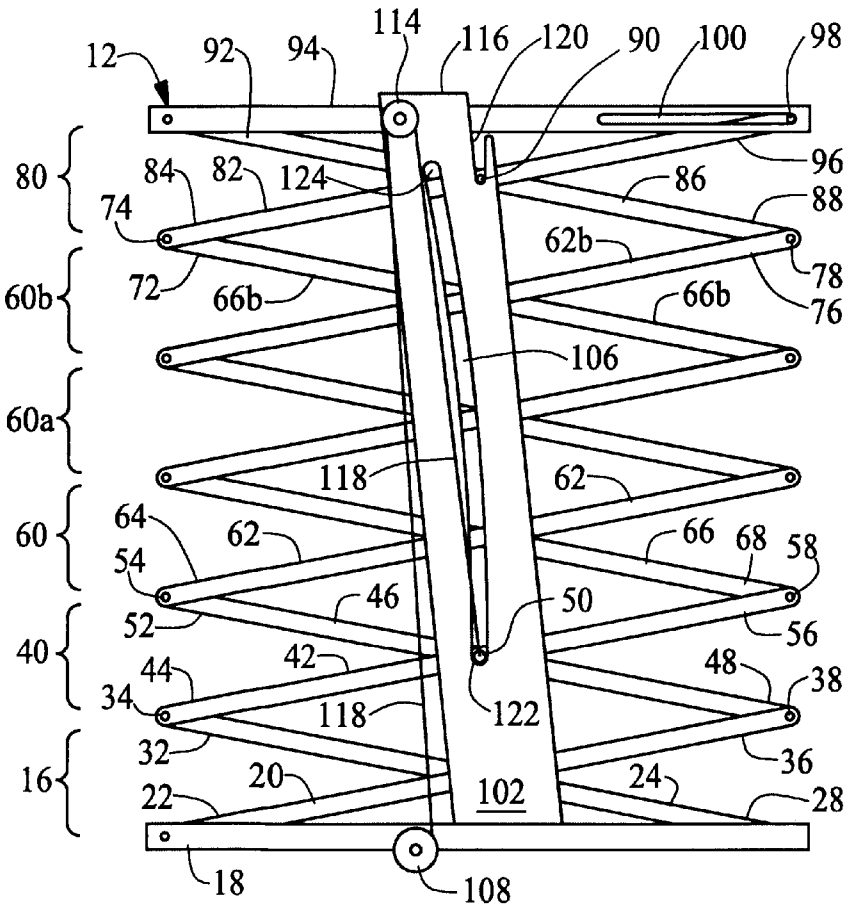
FIG. 1 is a side elevational view of one form of a lift assembly illustrative of an embodiment of the invention.

Referring to FIGS. 1 and 2, it will be seen that the illustrative scissors lift assembly 10 includes first and second elevator structures 12, 14 disposed side-by-side.

Figure 3:
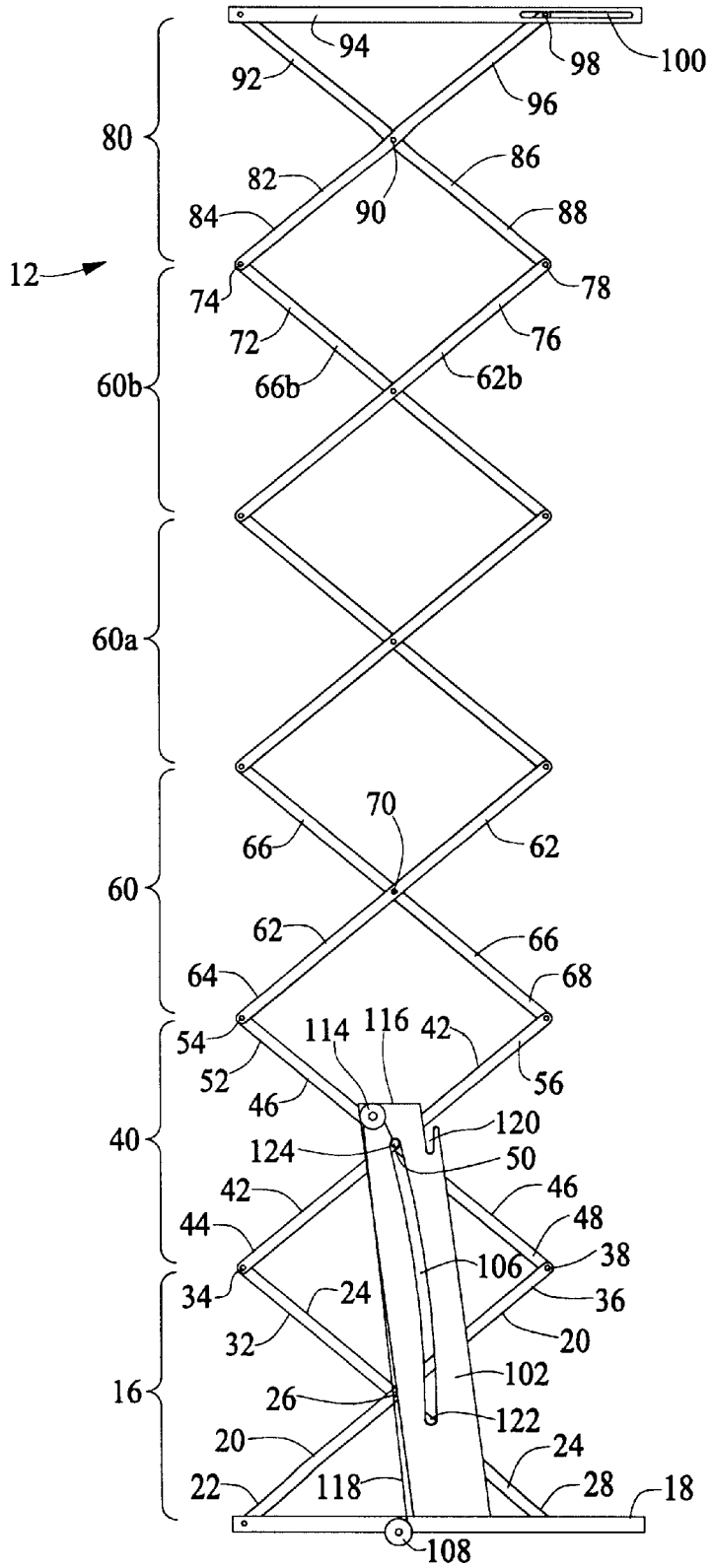
FIG. 3 is similar to FIG. 1, but illustrates the assembly in a different operational position.
Figure 4:
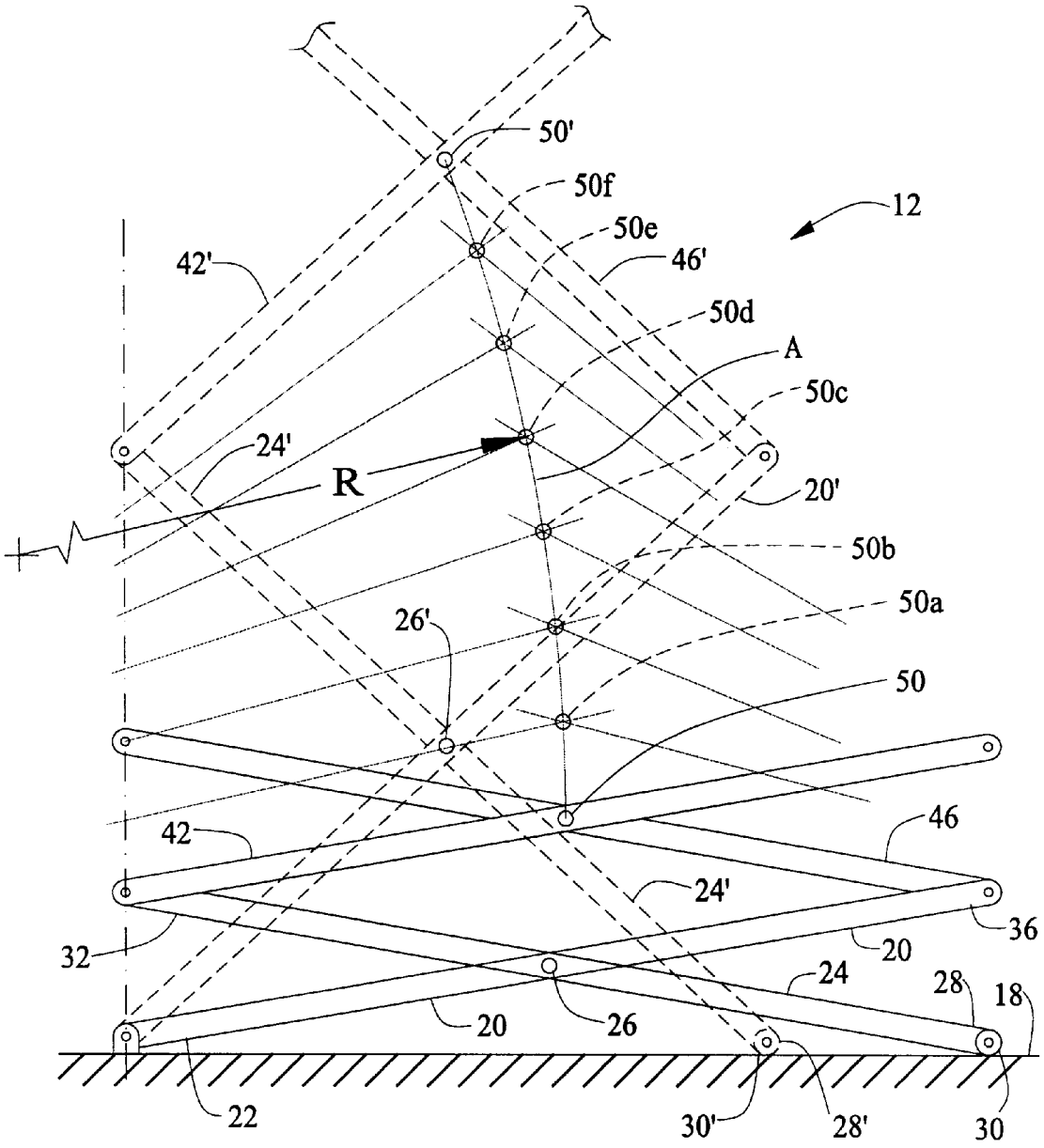
FIG. 4 is a diagrammatic view of a portion of the assembly, illustrating movement of such portions in operation of the assembly.

Each of the elevator structures 12, 14 includes a number of scissors sections disposed in a vertical array, including a first scissors section 16 mounted on a base bar 18. The first scissors section 16 includes a first arm 20 pivotally connected at a first end 22 to the base bar 18, and a second arm 24 pivotally connected to the first arm 20 at the center 26 (FIG. 3) of the first and second arms 20, 24. A first end 28 of the second arm 24 is movable along base bar 18, and for that purpose may be provided with a roller 30 (FIG. 4).

A second scissors section 40 includes a first arm 42 (FIGS. 1 and 3) pivotally connected at a first end 44 to a second end 32 of the first section second arm 24. The pivotal connection is effected by a first rod 34, which extends between and interconnects the first and second structures 12, 14. The second scissors section 40 further includes a second arm 46 pivotally connected at a first end 48 to a second end 36 of the first section first arm 20. The pivotal connection is effected by a second rod 38, which extends between and interconnects first and second structures 12, 14 (FIG. 2). The second section first and second arms 42, 46 are pivotally connected to each other by a lift shaft 50 which extends between and interconnects the first and second structures 12, 14 (FIG. 2).

At least one intermediate scissors section 60 (three shown in FIGS. 1–3; 60, 60*a*, 60*b*) includes a first arm 62 pivotally connected at a first end 64 to a second end 52 of the second section second arm 46 by a third rod 54 extending between and interconnecting the first and second structures 12, 14. The intermediate sections 60 further include a second arm 66 pivotally connected at a first end 68 to a second end 56 of the second section first arm 42 by a fourth rod 58 extending between and interconnecting the first and second structures 12, 14. The intermediate section first and second arms 62, 66 are pivotally connected to each other at the center 70 (FIG. 3) of the intermediate section first and second arms 62, 66.

Any further intermediate sections, such as 60*a* and 60*b* are substantially the same in structure as the intermediate section 60 described immediately above. The number of intermediate sections is selected based upon the height of the lift desired. For purposes of description, the uppermost intermediate section 60*b* in FIGS. 1 and 4 is provided with the reference characters 66*b* and 62*b* for identification of arms supporting an upper scissors section 80. It will be appreciated that the upper section 80 could just as well be supported by arms 62, 66.

The upper scissors section 80 includes a first arm 82 pivotally connected at a first end 84 to a second end 72 of second arm 66*b* of an uppermost 60*b* of the intermediate scissors sections by a fifth rod 74 extending between and interconnecting first and second elevator structures 12, 14. Similarly, the upper scissors section 80 includes a second arm 86 pivotally connected at a first end 8 to a second end 76 of the uppermost intermediate scissors section first arm 62*b* by a sixth rod 78 extending between and interconnecting first and second structures 12, 14 (FIG. 2). The upper section first and second arms 82, 86 are pivotally connected to each other at the centers of the upper section first and second arms 82, 86 by a locator pin 90 which extends outboard on both sides of the assembly 10. Alternatively, a discrete locator pin (not shown) may be provided in addition to a central connection pin 90.

A second end 92 of the upper section second arm 86 is pivotally connected to a top bar 94. A second end 96 of the upper section first arm 82 is provided with a pin 98 (FIGS. 1 and 3) slidably disposed in an elongated slot 100 in the top bar 94.

First and second generally rectangular side plates 102, 104 upstand alongside and, respectively, outbound of the first and second elevator structures 12, 14, described above. Each of the side plates 102, 104 defines an elongated slot 106 in which is disposed the lift shaft 50.

Lower pulleys 108 are mounted on or near the base bars 18 and are each mounted on a drive shaft 110, which is driven by a turning means 112, such as a motor (FIG. 2). An upper pulley 114 is mounted on each side plate 102, 104 proximate an upper end 116 of the side plate.

A strand 118 of metal wire, or other wire-like material, is wound about each lower pulley 108, which preferably is a spirally grooved pulley to ensure even winding of the strand 118. From the lower pulleys 108, the strands 118 extend upwardly, respectively, at least partially around upper pulleys 114 and downwardly alongside side plates 102, 104 and attach to lift shaft 50, which is movable in the slots 106.

The side plates 102, 104 may be inclined at an angle to the plane of the base bars 18. The upper end 116 of each side plate 102, 104 is provided with an open-ended slot 120 (FIGS. 1 and 3) configured to receive the locator pin 90. The elongated slot 106 in each side plate 102, 104 defines an arc A of a circle having a radius R (FIG. 4).

When idle, the lift assembly 10 is in a disposition shown in FIGS. 1 and 2. The lift shaft 50 rests at a lower end 122 of elongated slot 106, preventing the first and second scissors sections 16, 40 from stacking too tightly. Similarly, the locator pin 90 rests in the open ended slot 120, preventing the scissors sections 60, 60*a*, 60*b*, and 80, above the second section 40 from stacking tightly on the second section 40. With the lift shaft 50 coming to rest on lower end 122 of slot 106 and locator pin 90 resting in slot 120, scissors sections 16, 40, 60, 60*a*, 60*b* and 80 are prevented from collapsing to a point where excessive power would be required to extend the assembly 10.

A pallet, or basket, or other load support, or load (not shown), is placed on the top bars 94. The motor 112 is started, to rotate the drive shaft 110 and, thereby, the lower pulleys 108. As the strand 118 of wire, or similar material, is wound onto the lower pulleys 108, the wire pulls lift shaft 50 upwardly.

As the lift shaft 50 moves upwardly in slot 106, the shaft 50 follows a path through points 50*a*–50'; shown in FIG. 4, defining the arc A of a circle, and is stabilized by the rigid side plates 102, 104, each having the similarly configured slot 106 therein. As the locator shaft 50 moves upwardly the first section first arm 20 moves to the position labeled 20' in FIG. 4, and the first section second arm 24 moves along the base bar 18 and expands to the positions labeled 24' in FIG. 4. In similar fashion, arm 42 moves to position 42' and arm 46 moves to the position labeled 46' in FIG. 4. In short order, typically 3–4 seconds, the assembly has expanded to the configuration shown in FIG. 3. When the lift shaft 50 engages an upper end 124 of the curved slot 106, the movement of the scissors sections is complete. The linear movement of the first section second arm first end 28 and roller 30 to positions labeled 28' and 30', respectively, and the linear movement of the upper section first arm second end pin 98 within slot 100 maintain a parallel relationship between the base bar 18 and the top bar 94.

Figure 5:
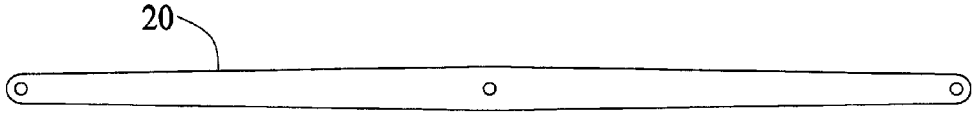
FIG. 5 is a side elevational view of a representative arm of the assembly.

Referring to FIG. 5, it will be seen that a preferred configuration of the arm 20, as well as other arms 24, 42, 46, 62, 66, 82 and 86, is tapered from a selected thickness at the center of the arm to a lesser thickness at either end thereof.

It will be understood that many additional changes in the details, materials, steps and arrangement of parts, which have been herein described and illustrated in order to explain the nature of the invention, may be made by those skilled in the art within the principles and scope of the invention as expressed in the appended claims. As an example, assembly 10 may be constructed with a single elevator structure 12. Line L in FIG. 2 indicates a suitable point at which assembly 10 may be split into two portions, each having a single elevator structure 12. Shaft 50 is shown with an end portion 50*a* having a larger diameter than the portion of shaft 50 passing through side plate 102 and arms 42, 46, so as to prevent shaft 50 from disengaging from structure 12. Similar means would be used for rods 38, 58 and 78 and drive shaft 110. It is to be noted that turning means 112 may be a hand crank and that assembly 10 may also be operated by simply pulling on strand 118, without requiring the use of turning means 112 and drive shaft 110. It is also to be noted that the construction of assembly 10 does not require a payload to be placed above top bars 94. Rather, the construction of assembly 10 allows for a payload to be suspended between structures 12 and 14, extending to shaft 50.

What is claimed is:

1. A lift assembly comprising:

a first scissors section mounted on a base bar;

a second scissors section pivotally connected to said first scissors section, arms of said second scissors section being pivotally connected to each other by a lift shaft;

at least one intermediate scissors section pivotally connected to said second scissors section;

an upper scissors section pivotally connected to an uppermost of said intermediate scissors sections and supporting a top bar;

a first side plate upstanding adjacent the scissors sections and having therein an elongated slot defining an arc of a circle, the lift shaft being disposed in the slot;

an upper pulley mounted proximate an upper end of said first side plate; and a strand extending to said upper pulley and thence to the lift shaft, whereby drawing said strand at an end remote from said lift shaft over said upper pulley draws the lift shaft upwardly in said side plate slot, to draw said second scissors section, and thereby remaining scissors sections, upwardly, to raise the top bar.

2. The lift assembly in accordance with claim 1 wherein said side plate is generally rectangular in configuration and is disposed at an angle to a plane of the base bar.

3. The lift assembly in accordance with claim 1 wherein an upper end of said first side plate is provided with an open ended slot and said upper scissors section is provided with locator pin means, said open ended slot being adapted to receive said locator pin means to limit downward movement of the scissors sections.

4. The lift assembly in accordance with claim 1 further comprising:

a second set of scissors sections complementary to the first, second, intermediate and upper scissors sections, the lift shaft extending between the second scissors section and a corresponding scissors section of the second set of scissors sections, the second set of scissors sections being on a side of the first, second, intermediate and upper scissors sections opposite the first side plate; and a second side plate upstanding adjacent the second set of scissors sections on a side opposite the first, second, intermediate and upper scissors sections, the second side plate having therein a second elongated slot corresponding to the elongated slot of the first side plate, the lift shaft being further disposed in the second slot.

5. The lift assembly in accordance with claim 1 further comprising a lower pulley mounted proximate the base bar, the end of the strand remote from the lift shaft extending from the upper pulley to the lower pulley, whereby rotation of the lower pulley draws the strand to raise the top bar.

6. The lift assembly in accordance with claim 5 further comprising:

a drive shaft fixed to a rotational axis of the lower pulley; and a motor for rotating the drive shaft, thereby to rotate the lower pulley.

7. The lift assembly according to claim 1 further comprising a roller mounted on a first end of the first scissors section and engaged with said base bar, a second end of said first scissors section pivotally connected to said base bar.

8. A lift assembly having first and second elevator structures side-by-side, each of the structures comprising:

a base bar;

a first scissors section mounted on said base bar and comprising;

a first arm pivotally connected at a first end thereof to said base bar; and a second arm pivotally connected to said first arm at the centers of said first and second arms, a first end of said second arm being movable along said base bar;

a second scissors section comprising:

a first arm pivotally connected at a first end thereof to a second end of said first section second arm by a first, rod which extends between the first and second structures;

a second arm pivotally connected at a first end thereof to a second end of said first section first arm by a second rod which extends between the first and second structures;

said second section first and second arms being pivotally connected to each other by a lift shaft which extends between the first and second structures;

at least one intermediate scissors section comprising:

a first arm pivotally connected at a first end thereof to a second end of said second section second arm by a third rod extending between the first and second structures; and a second arm pivotally connected at a first end thereof to a second end of said second section first arm by a fourth rod extending between the first and second structures;

said intermediate section first and second arms being pivotally connected to each other at the centers of said intermediate section first and second arms; and an upper scissors section comprising:

a first arm pivotally connected at a first end thereof to a second end of the second arm of an uppermost of said intermediate scissors section by a fifth rod extending between the first and second structures;

a second arm pivotally connected at a first end thereof to a second end of the uppermost intermediate scissors section first arm by a sixth rod extending between the first and second structures, said upper section first and second arms being pivotally connected to each other at the center of said upper section first and second arms;

a second end of said upper section second arm being pivotally connected to a top bar;

a second end of said upper section first arm being slidably disposed in an elongated slot in the top bar;

first and second rigid side plates upstanding alongside and, respectively, outboard of the first and second structures, each of said side plates having therein an elongated slot defining an arc of a circle, the lift shaft being disposed in the slots;

a lower pulley mounted proximate each of said base bars on a common drive shaft;

a motor for rotating the drive shaft;

an upper pulley mounted proximate an upper end of each of said side plates; and a wire strand extending from each of said lower pulleys to each of said upper pulleys, respectively, and thence to said lift shaft;

whereby operation of said motor rotates the drive shaft to rotate said lower pulleys to draw in said wire strands from said upper pulleys to draw the lift shaft upwardly in the side plate slots, to draw said second scissors section, and thereby remaining scissors sections, upwardly to raise the top bar.

9. The lift assembly in accordance with claim 8 wherein said side plates are generally rectangular in configuration and are disposed at an angle to a plane of said base bars.

10. The lift assembly in accordance with claim 8 wherein an upper end of each of said side plates is provided with an open ended slot, and each of said upper scissors sections is provided with locator pin means, said open ended slots being adapted to receive said locator pins to limit downward movement of the scissors sections.

11. The lift assembly in accordance with claim 10 wherein the lift shaft in the side plate slots is engageable with upper ends of the side plate slots to limit upper travel of said second scissors section and thereby of remaining scissors sections, and is engageable with lower ends of the side plate slots to limit downward travel of said second scissors section, while said locator pin means limits downward travel of scissors sections above said second scissors section.

12. The lift assembly in accordance with claim 8 and further comprising a roller mounted on said first end of said first scissors section second arm and engaged with said base bar.

13. The lift assembly in accordance with claim 8 and further comprising a pin extending from said second end of said upper section first arm, said pin being slidably disposed in the elongated slot in the top bar.

14. The lift assembly in accordance with claim 8 wherein said arms are tapered from a selected thickness at a center thereof to a lesser thickness at either end thereof.

* * * * *